US005752129A

United States Patent [19]

Sugiyama

[11] Patent Number: 5,752,129

[45] Date of Patent: May 12, 1998

[54] IMAGE FORMING APPARATUS HAVING A SUPPLEMENTAL HEATING SOURCE

[75] Inventor: Kazuhide Sugiyama, Yokohama, Japan

[73] Assignee: Canon Kabushiki Kaisha, Tokyo, Japan

[21] Appl. No.: 674,735

[22] Filed: Jul. 2, 1996

[30] Foreign Application Priority Data

Jul. 5, 1995 [JP] Japan ..... 7-191035
Mar. 25, 1996 [JP] Japan ..... 8-094842

[51] Int. Cl.[6] ..... G03G 15/70; G03G 15/00

[52] U.S. Cl. ..... 399/92; 399/144; 399/148; 399/335

[58] Field of Search ..... 399/92–95, 144, 399/148, 335; 355/30; 432/59

[56] References Cited

U.S. PATENT DOCUMENTS 3,792,964 2/1974 Chatterji ..... 432/59
4,021,107 5/1977 Morita ..... 399/148
4,739,368 4/1988 Lachut et al. ..... 399/144 X
4,804,576 2/1989 Kuge et al. ..... 428/216
5,038,170 8/1991 Serita ..... 399/92
5,486,882 1/1996 Yamaguchi et al. ..... 353/77

*Primary Examiner*—Joan H. Pendegrass
*Attorney, Agent, or Firm*—Fitzpatrick, Cella, Harper & Scinto

[57] ABSTRACT

An image forming apparatus includes an image illuminating section having an illuminating lamp for projecting an image and a heater-type fixing device. In the image forming apparatus, the image illuminating section and the heater-type fixing device are adjacent to each other, and the fixing device is heated by the heat of the illuminating section. This prevents a waste of energy, shortens the rise time of the fixing device and the operating time of a heater for heating a heating roller of the fixing device, and obtains good fixing properties even in a low-temperature environment.

16 Claims, 9 Drawing Sheets

IMAGE FORMING APPARATUS HAVING A SUPPLEMENTAL HEATING SOURCE

BACKGROUND OF THE INVENTION

1. Field of the Invention

The present invention relates to an image forming apparatus, for example, such as a microfilm reader printer in which an image on a recording medium such as a microfilm is illuminated by an image illuminating section including an illuminating lamp. The image is enlarged and projected on a photosensitive body by a projection optical system including a projection lens to form a duplicate image, and the duplicate image is heated and fixed on a recording sheet such as paper by a heater-type fixing device to effect printing.

2. Description of the Related Art

A heater-type fixing device in a conventional image forming apparatus of this type is, as shown in FIG. 4, composed of a heating roller 21, a heater 22 contained in the heating roller 21 and a pressure roller 25 which is provided so as to be opposed to the heating roller 21. Paper P which is a transfer material and a toner T which forms an image is heated between the rollers 21 and 25 so that the image is fixed to the paper P.

In such a heater-type fixing device, it is necessary to heat the heating roller 21 to temperatures above a predetermined temperature in order to obtain a sufficient fixing property. Conversely, it is also necessary to prevent an excessive temperature rise in order to prevent a breakdown and a firing of the apparatus. Therefore, a proper temperature is maintained by ON/OFF control of the heating roller 21.

However, the image forming apparatus having the above heater-type fixing device raises the following problems:

1) Considerable waiting time is required before the fixing device is brought to a state in which printing is possible after turning on the power to actuate the heater 22. During the waiting time, a large amount of energy is consumed.
2) A poor heat insulating efficiency of the heater-type fixing device causes a frequent ON/OFF switching of the heater 22, thereby affecting the life of the heater 22, and resulting in a waste of energy.
3) In a low-temperature environment, the heat of the heating roller 21 is rapidly removed by a cooled transfer material. Thus, when printing is continuously performed, heating does not sufficiently influence the printing operation so that a defect in fixing is generated.

SUMMARY OF THE INVENTION

It is an object of the present invention to provide an image forming apparatus which can prevent a waste of energy, shorten the rise time of a heater-type fixing device and the operating time of a heater for heating the heating roller, and provide good fixing properties even in a low-temperature environment.

In one aspect of the present invention, there is provided an image forming apparatus which can be switched between a reader mode for projecting an image on a recording medium onto a screen for observation and a printer mode for scanning and exposing the image to an exposure section to obtain a copied image and which comprises an illuminating lamp for illuminating a recording medium, and a heater-type fixing device for fixing the copied image on a recording sheet, wherein the heater-type fixing device is heated by the heat of the lamp in the reader mode.

In another aspect of the present invention, there is provided an image forming apparatus which can be switched between a reader mode for projecting an image on a recording medium onto a screen for observation and a printer mode for scanning and exposing the image to an exposure section to obtain a copied image, and which comprises an illuminating section having a lamp for illuminating a recording medium, and a heater-type fixing device, wherein the illuminating section and the heater-type fixing device are adjacent to each other so that the heater-type fixing device is heated by the heat of the lamp in the reader mode.

According to the present invention, the ambient temperature of the heater-type fixing device is increased by using the heat emitted from the image illuminating section so that the heater-type fixing device is warmed. This operation is to be performed in the reader mode when the image forming apparatus can be switched between the reader mode and the printer mode.

In addition, since the image illuminating section and the heater-type fixing device are adjacent to each other, the ambient temperature of the heater-type fixing device is increased by the heat emitted from the image illuminating section so that the heater-type fixing device is warmed. This operation may be performed in the reader mode as described above.

As described above, it is possible to supplementarily warm the heater-type fixing device at all times, or only in the reader mode so that the heater-type fixing device can be maintained in the heated state required for good fixing.

In addition, when the image forming apparatus can be switched between the reader mode and the printer mode, the proper value and the upper limit value of the light amount of the illuminating lamp required for printing in the printer mode may be determined by the sensitivity and the properties of the exposure section. However, by increasing the light amount of the illuminating lamp in the reader mode to be larger than that of the printer mode, it is possible to perform efficiently the supplementary heating of the heater-type fixing device.

Further, the proper value and the upper limit value of the light amount of the illuminating lamp for projecting an image may be sometimes determined for the purpose of preventing deterioration of the image, and in accordance with the preference and eyesight of the operator. However, by increasing the light amount of the illuminating lamp in the printer mode to be larger than that of the reader mode, it is possible to perform efficiently the supplementary heating of the heater-type fixing device.

Still further, even when the proper value and the upper limit value of the light amount of the illuminating lamp required in the printer mode and the reader mode are determined, by selecting the light amount of the illuminating lamp to the value corresponding to that of the printer mode, the reader mode and the switching between these modes, and by increasing the light amount of the illuminating lamp in switching between the printer mode and the reader mode, it is possible to perform efficiently the supplementary heating of the heater-type fixing device.

DETAILED DESCRIPTION OF THE PREFERRED EMBODIMENTS

Figure 1:
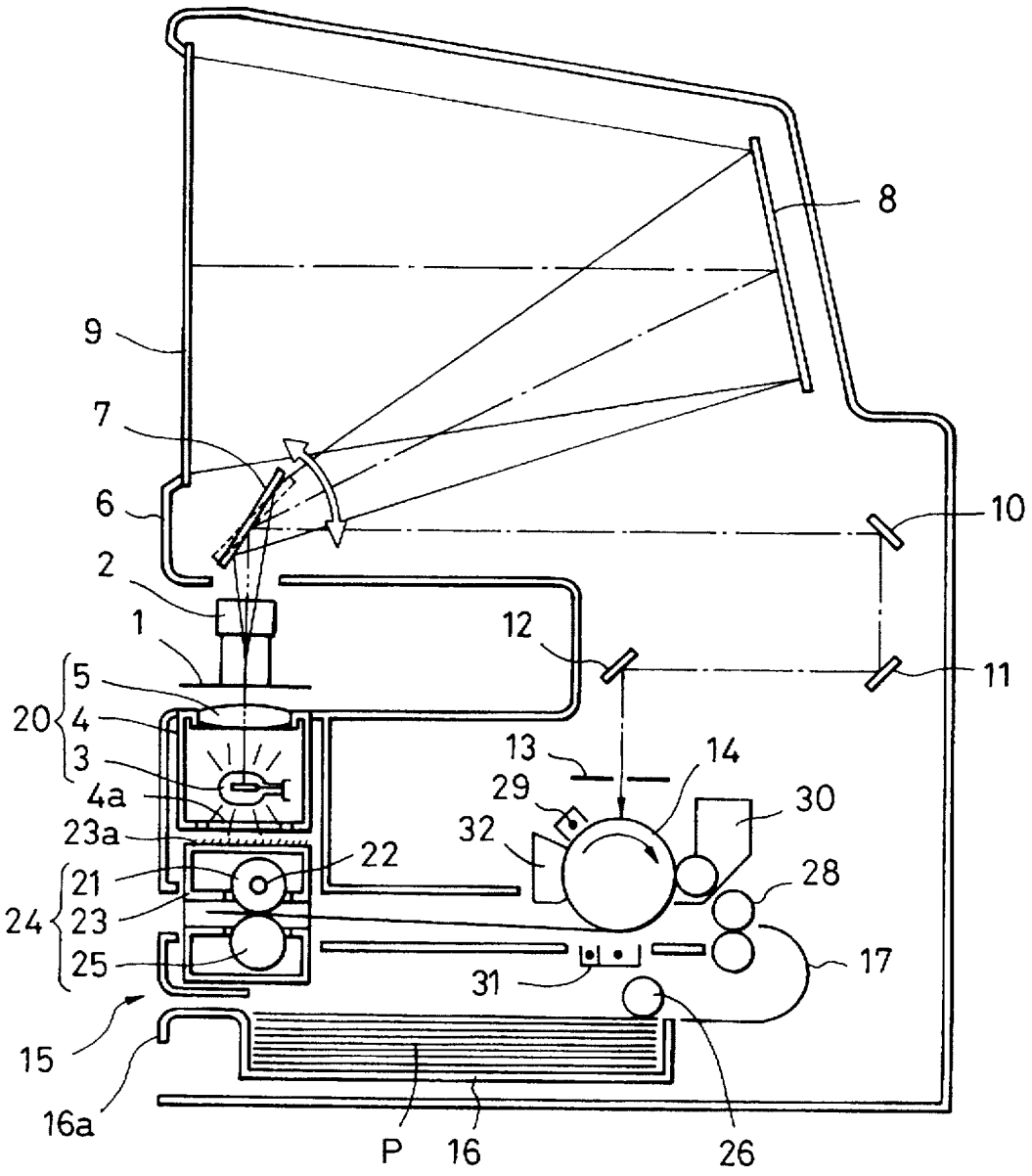
FIG. 1 is a schematic view showing a construction of a reader printer as an image forming apparatus according to a first embodiment of the present invention.

FIG. 1 illustrates a reader printer as an image forming apparatus according to a first embodiment of the present invention.

Referring to FIG. 1, there is shown a microfilm 1 in which an image is recorded, and a projection lens 2. An image illuminating section (hereinafter, referred to simply as an illuminating section) 20 is composed of an illuminating lamp 3, a collective lens 5 and a box-shaped illumination frame 4 which supports the illuminating lamp 3 and the collective lens 5, with the lamp 3 and lens 5 exposed to the projection lens 2. The light of the illuminating lamp 3 is directed to the microfilm 1 by means of the collective lens 5.

A halogen lamp is usually used as the illuminating lamp 3, and considerable heat is generated in the illuminating section. The illuminating lamp 3 is not limited to a halogen lamp, and a fluorescent lamp may be used. It is essential only that the lamp can generate heat.

The light which has passed through the microfilm 1 enters a casing 6, which is a main body of the apparatus, through the projection lens 2.

When the apparatus is placed in the reader mode, the lamp 3 illuminates, the light transmitted through the projection lens, i.e. the light entered in the casing 6, is sequentially reflected from the mirrors 7 and 8 of the casing 6 to be projected on a transmission-type projection screen 9 on the front of the apparatus, and the image information of the microfilm 1 is projected to form an enlarged image on the projection screen 9. In this way, the image can be observed from the outer surface of the projection screen 9.

On the other hand, when the apparatus is placed in the printer mode, the mirror 7 is rotated by a driving means (not shown) from a position shown by a solid line where the mirror is at rest to a position shown by a broken line by means of a driving means (not shown), whereby the light reflected from the mirror 7 is sequentially reflected from printing mirrors 10, 11 and 12 within the casing 6 and reaches a photoconductive drum 14, which rotates at a constant speed, through a slit 13 so that the enlarged image of the microfilm 1 is slit-exposed to the photoconductive drum 14.

A construction of a printer section 15 will now be described.

The printer section 15 is provided at a lower portion in the casing 6, and constituted by the photoconductive drum 14, a detachable paper feeding cassette 16 containing print papers P as transfer materials, a U-shaped reversal paper carrier path 17 and a heater-type fixing device (hereinafter, referred to simply as a fixing device) 24. As for the fixing device 24, the same components as those shown in the prior art are indicated by the same reference numerals.

Figure 4:
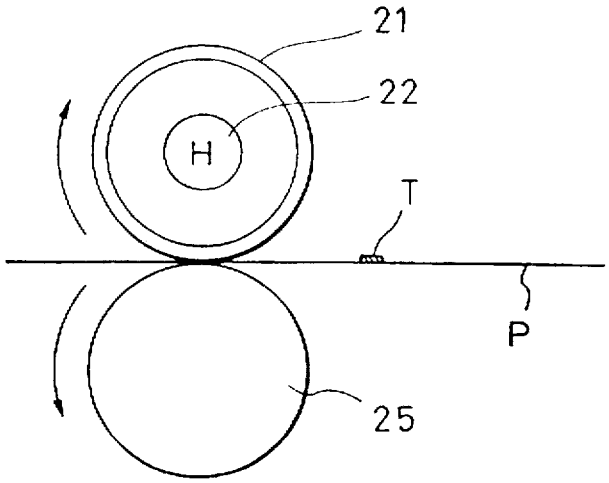
FIG. 4 PRIOR ART
FIG. 4 is a schematic view showing a general construction of a heat-type fixing device.

The fixing device 24 is provided vertically adjacent to the illuminating section 20, and consists of a heating roller 21, a heater 22 contained in the heating roller 21, a pressure roller 25 which is provided so as to be opposed to the heating roller 21, and a fixing device frame 23 for storing and supporting these components. A toner T forming an image on the surface of the print paper P is heated between the rollers 21 and 25 so that a toner image is fixed on the print paper P (See FIG. 4).

The paper feeding cassette 16 which can set from the front (the left-hand side in FIG. 1) of the casing 6 has a grip portion 16*a* at the forward part thereof, and is provided at the lowermost portion in the casing 6.

An operation near the printer section at the time of printing will now be described.

The print papers P as image forming sheets contained in the paper feeding cassette 16 are separated and fed one at a time to the reversal paper carrier path 17 by cooperation between a paper feeding roller 26 and a separation member (not shown), and carried forward along a U-shaped path by the reverse paper carrier path 17. Thereafter, the print paper P is fed to the photoconductive drum 14 by a pair of resist rollers 28. A charging device 29, a developing device 30, a transfer charging device 31 and a cleaning device 31 are provided around the photoconductive drum 14, and the toner image of the microfilm 1 formed on the photoconductive drum 14 by a known electrophotographic process is transferred to the print paper P. The print paper P subjected to image transferring passes through the fixing device 24 to be subjected to an image fixing, and then discharged on a paper discharging tray.

In this embodiment, the fixing device 24 is provided directly below the illuminating section 20, as shown in FIG. 1. Therefore, the ambient temperature of the fixing device 24 is increased by heat from the illuminating section in the reader mode so that the rollers 21 and 25 of the fixing device are also warmed.

Figure 5:
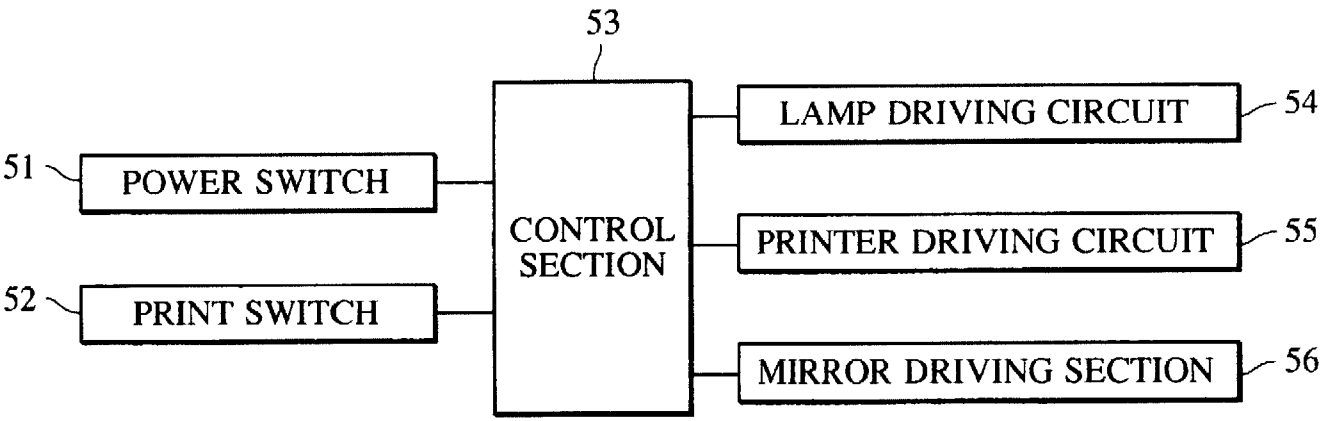
FIG. 5 is a block diagram showing a control of a reader printer as an image forming apparatus according to the present invention.

FIG. 5 is a block diagram showing a control of the reader printer. Each of the elements shown in block outline in FIG. 5 is well known der se, and a specific type of construction is not critical to carrying out the invention or to a disclosure of the best mode for carrying out the invention. Referring to FIG. 5, a control circuit 53 includes a power switch 51 and a print switch 52 as an input section, and a lamp driving circuit 54, a printer driving circuit 55 and a mirror driving section 56 as an output section.

The power switch 51 switches between ON and OFF the power of the reader printer. When the power is turned ON, the apparatus is placed in the reader mode.

When the print switch is turned ON, the reader mode is switched to the printer mode.

The lamp driving circuit 54 causes the illuminating lamp 3 to illuminate.

The printer driving circuit 55 drives the printer section 15 in order to effect printing on the print paper P.

The mirror driving section 56 rotates the mirror 7 in accordance with the reader mode and the printer mode.

Figure 6:
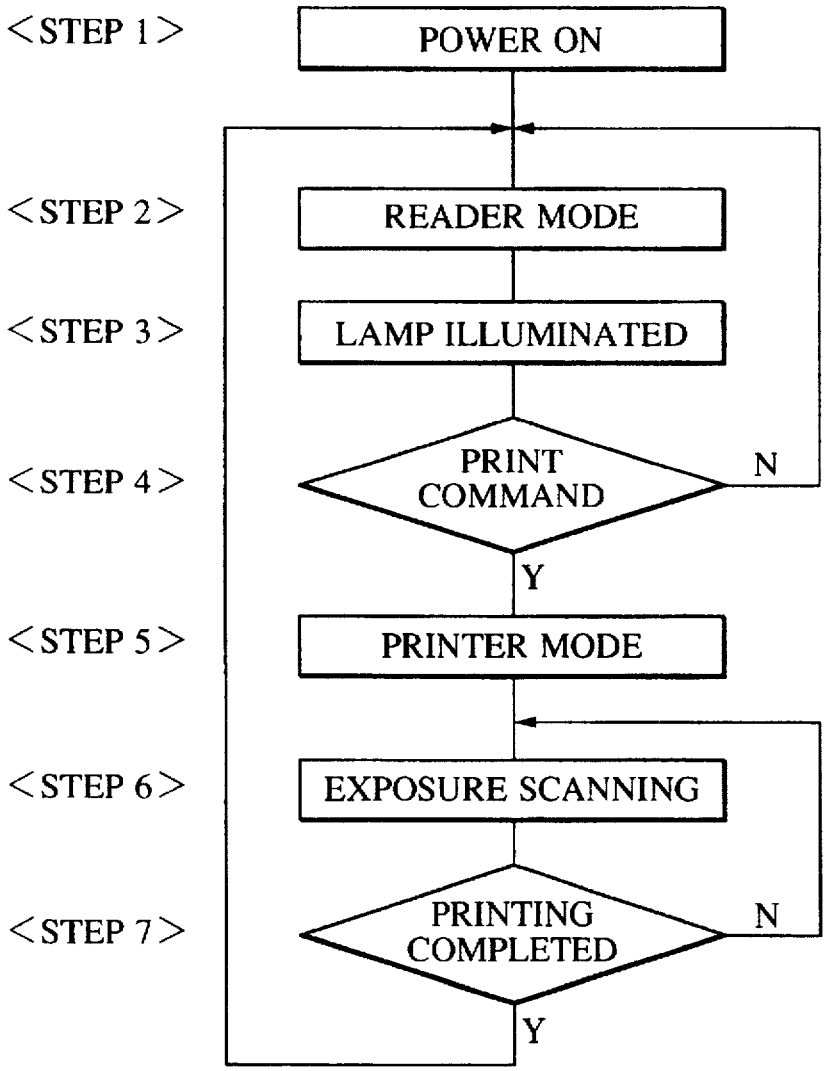
FIG. 6 is a flowchart showing an operation of a reader printer as an image forming apparatus according to the first embodiment of the present invention.

FIG. 6 is a flowchart showing an operation of the apparatus.

When an operator turns the power ON by means of the power switch 51 (step 1), the apparatus is placed in the reader mode (step 2), the illuminating lamp 3 is illuminated by the lamp driving circuit 54 (step 3) and the image of the microfilm 1 is projected on the projection screen 9.

When a print command is generated by the print switch 52 (step 4), the reader mode is switched to the printer mode (step 5), the printer section 15 is actuated and the mirror 7 is rotated so that the image is exposed to the photoconductive drum 14. Image exposure is performed until printing is completed (step 6 and step 7). When printing is completed, the printer mode is returned to the reader mode. Therefore, unless the print command is generated in step 4, steps 2 and 3 are repeated so that a supplementary heating of the fixing device 24 due to illumination of the illuminating lamp 3 is performed.

Since the fixing device 24 is supplementarily warmed in the reader mode, the following advantages may be provided.

The rise time of the fixing device can be shortened. In addition, a heat insulation condition of the fixing device 24 is improved, whereby the operating time of the heater 22 can be shortened. Further, good fixing properties can be obtained even in a low-temperature environment.

Still further, the supplementary heating is economical and reduces energy consumption because it is performed by using heat generated by the illuminating lamp 3.

In this embodiment, a through hole 4*a* is formed in the bottom of the illumination frame 4 so that the light from the illuminating lamp 3 directly illuminates the fixing device 24. This will allow not only convection heat but also radiation heat from the illuminating lamp 3 to be supplied to the fixing device 24. Thus, the above-described advantages can be achieved more effectively.

In addition, when an outer wall 23*a* of a fixing device frame 23 is colored black by painting or the like, heat absorptivity is increased and the fixing device 24 is further heated, whereby the above-described advantages can be achieved more effectively.

Figure 2:
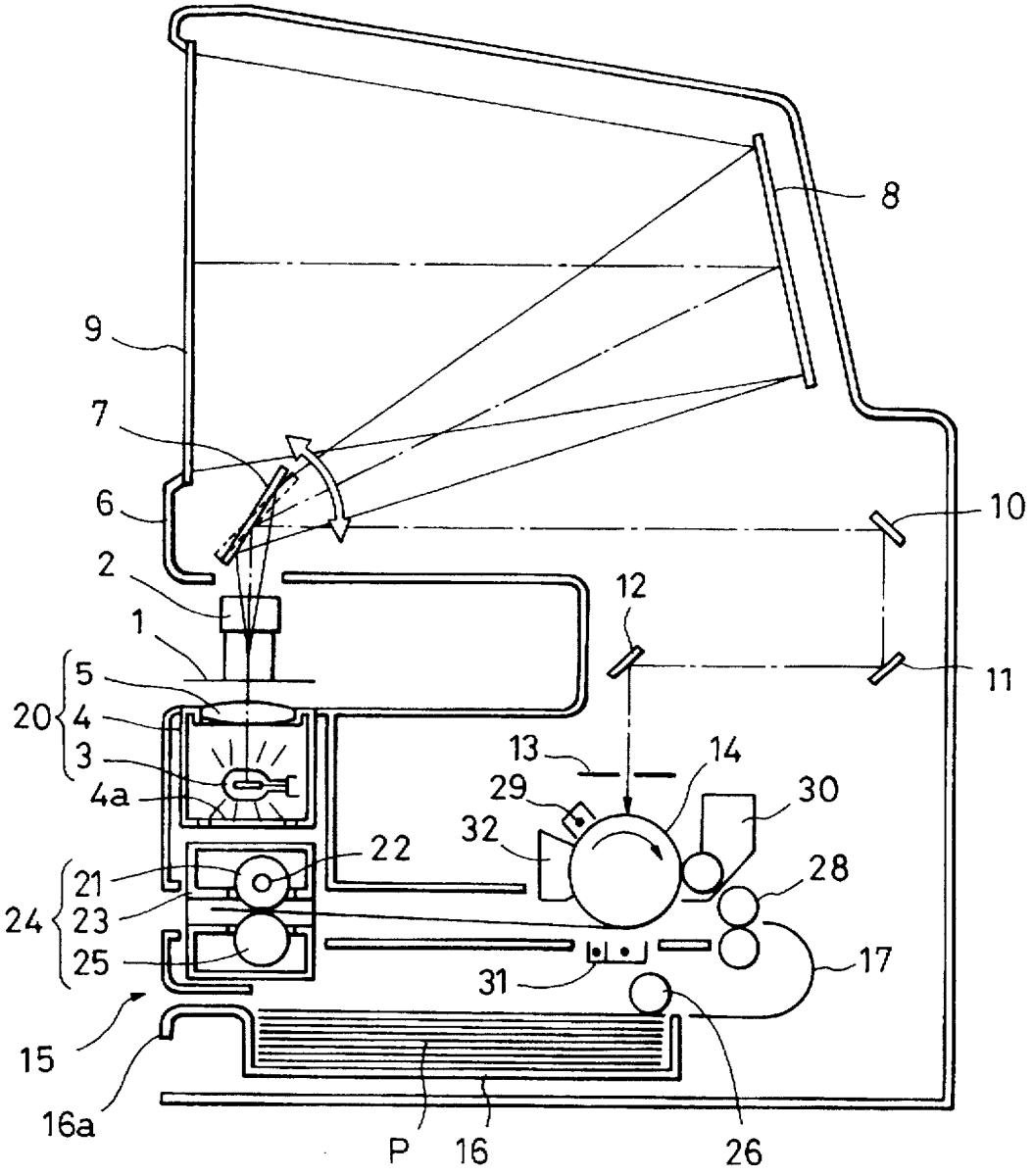
FIG. 2 is a schematic view showing a construction of a reader printer as an image forming apparatus according to a second embodiment of the present invention.

FIG. 2 illustrates a second embodiment of the present invention. In this embodiment, the upper portion of the fixing device frame 23, i.e., the illuminating lamp 3 side of the fixing device frame 23 in the first embodiment, is opened so that the light of the illuminating lamp 3 is directly applied to the roller 21 through the through hole 4*a*.

This is able to compensate for the heat of the heating roller 21 removed by a cooled transfer material (print paper P), particularly in a low-temperature environment. Thus, no fixing defect due to deficient heating will be generated.

In this embodiment, since the other constructions, functions, block diagrams of the control, and the flowchart of the operation of the apparatus are the same as those of the first embodiment, the same components are indicated by the same reference numerals shown in FIGS. 1, 5 and 6 and an explanation thereof has been omitted.

Figure 3:
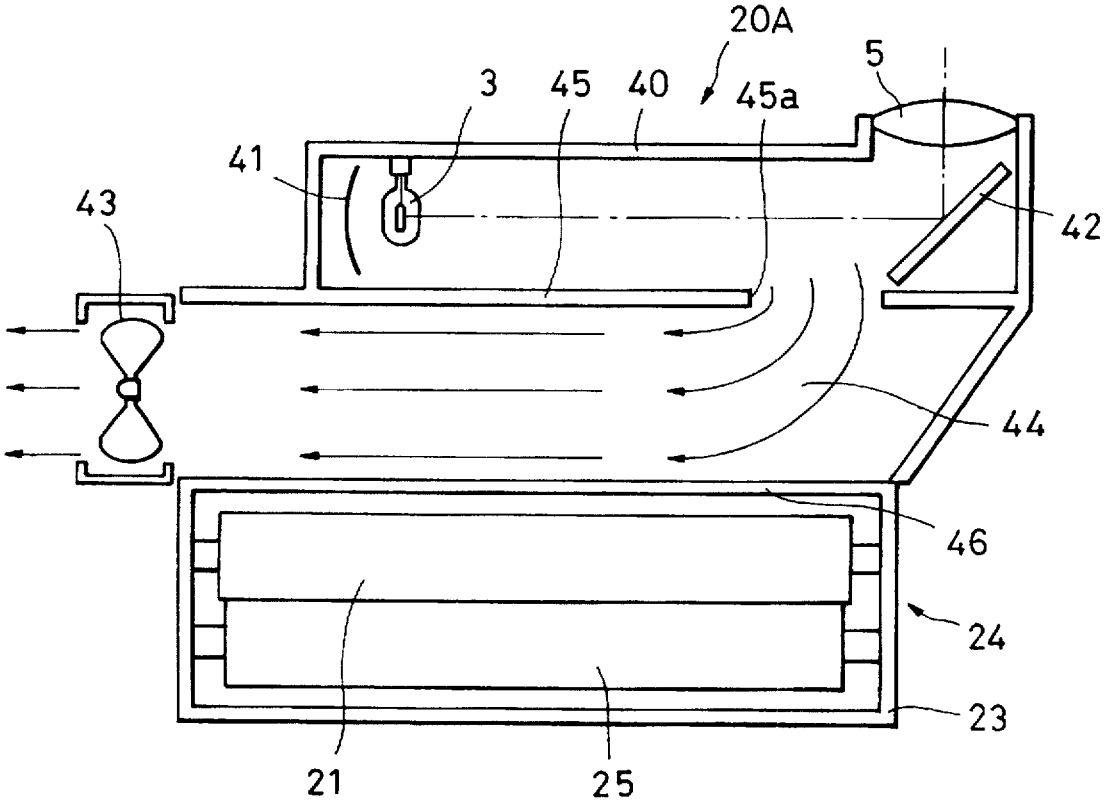
FIG. 3 is a schematic view showing a construction around an illuminating section and a heater-type fixing device of a reader printer as an image forming apparatus according to a third embodiment of the present invention.

A third embodiment of the present invention is shown in FIG. 3. In FIG. 3, the same components as those in the first and second embodiments are indicated by the same references.

FIG. 3 illustrates the periphery of the illuminating section 20A and the fixing device 24 of the reader printer, viewed from surfaces of the rollers 21 and 25 of the fixing device 24.

In this embodiment, an exhaust duct 44 and an exhaust fan 43 are provided between the illuminating section 20A and the fixing device 24.

The illuminating section 20A consists of the illuminating lamp 3, a reflector 41 for effectively taking in the light from the illuminating lamp 3, a reflecting mirror 42 for changing the direction of travel of the light, the collective lens 5 for collecting the light from the reflecting mirror 42, and an illumination frame 40 which supports the reflector 41, the reflecting mirror 42 and the illuminating lamp 3 with the collective lens exposed to the projection lens (not shown).

And, the fixing device 24 is provided at a lower portion of the illuminating section 20A with a predetermined space therebetween. Since the construction of the fixing device 24 is the same as that of the above-described embodiments, an explanation thereof has been omitted.

On the other hand, a breakthrough 45*a* is formed in an outer wall 45 of the illumination frame 40 in regard to the fixing device 24 (the lower portion in FIG. 3).

A space is formed between the outer wall 45 of the illumination frame 40 and an outer wall 46 of the fixing device frame 23 in regard to the illuminating section 20A. One portion of the space in the axial direction of the rollers 21 and 25 of the fixing device 24 (the right-hand side in FIG. 3) is closed and the other portion (the left-hand side in FIG. 3) is opened, and the exhaust fan 43 is provided at the opened portion. That is, the exhaust duct 44 is provided between the illumination frame 40 and the outer walls 45 and 46 of the fixing device frame 23 for discharging heat generated from the illuminating lamp 3 out of the casing 6 through the hole 45*a*.

In such a construction, hot air, which is to be discharged, passing through the exhaust duct 44 will warm the fixing device 24, thereby achieving the above advantages.

In addition, since hot air is discharged, the fixing device 24 will not be overheated. Therefore, a breakdown of the apparatus due to heating of the fixing device 24 can be prevented.

Figure 7:
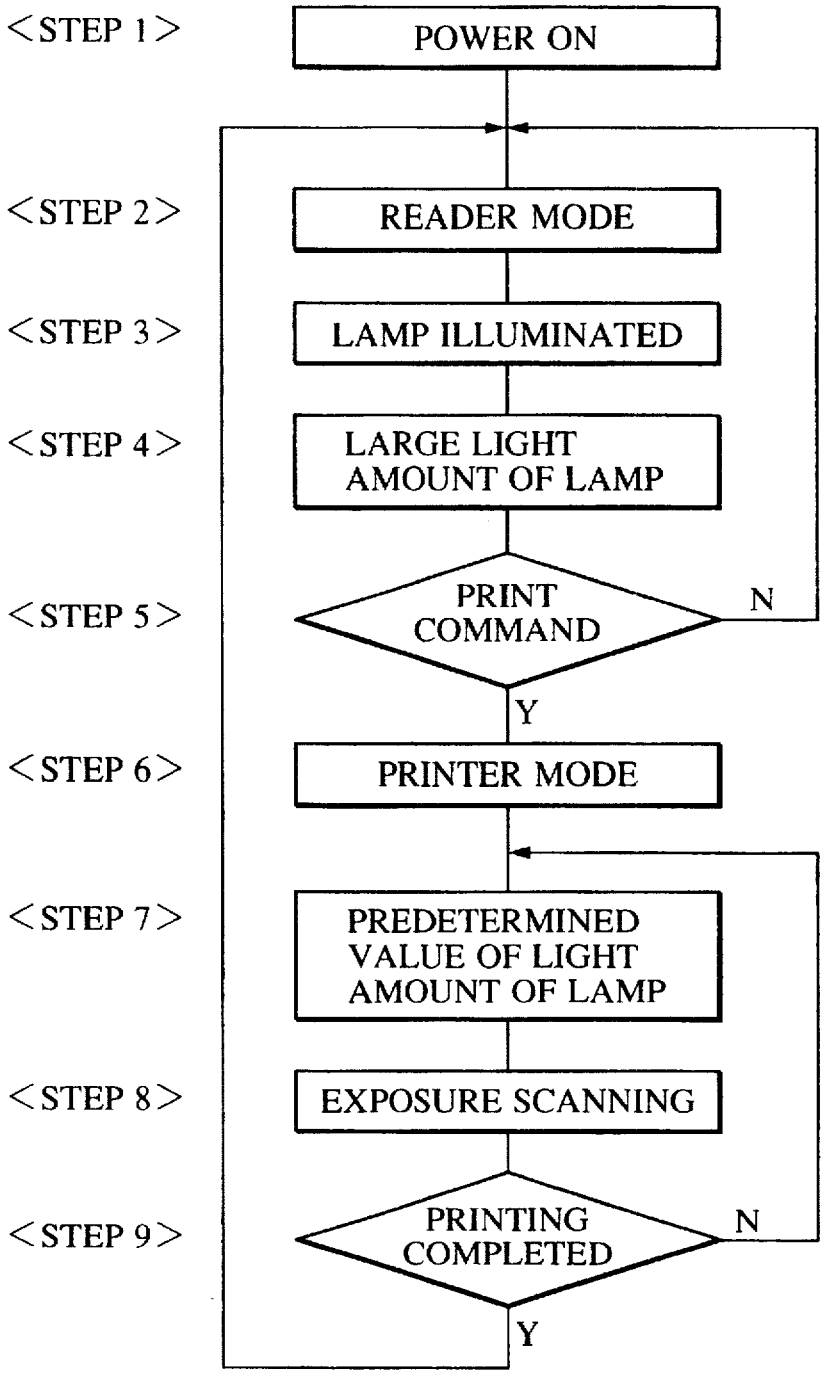
FIG. 7 is a flowchart showing an operation of a reader printer as an image forming apparatus according to a fourth embodiment of the present invention.

FIG. 7 is a flowchart showing the operation of the reader printer as the image forming apparatus according to a fourth embodiment of the present invention. The flowchart of the operation will now be described. Since this embodiment is characterized by only the flowchart of the operation with respect to the above first to third embodiments, the construction, function and block diagram of the control of the reader printer according to this embodiment are the same as those of the above first to third embodiments, and an explanation thereof has been omitted.

When an operator turns the power ON by means of the power switch 51 (step 1), the apparatus is placed in the reader mode (step 2), the illuminating lamp 3 is illuminated by the lamp driving circuit 54 (step 3) and a light amount of the illuminating lamp 3 in the reader mode is increased to be larger than that of the printer mode (step 4).

Thereafter, when a print command is generated by the print switch 52 (step 5), the reader mode is switched to the printer mode (step 6), the light amount of the illuminating lamp 3 is set to a predetermined value smaller than that of the reader mode in accordance with sensitivity and performance of the photoconductive drum 14 (step 7) and image exposure is performed until printing is completed (steps 7 to 9). However, unless the print command is generated in step 5, steps 2 to 4 are repeated so that a supplementary heating of the fixing device 24 due to illumination of the illuminating lamp 3 is performed.

As described above, this embodiment is characterized in that the light amount of the illuminating lamp 3 in the reader mode is increased to be larger than that of the printer mode by step 4 and step 7.

It is necessary to set the proper value and upper limit value of the light amount of the illuminating lamp 3 required for printing in accordance with the sensitivity and the properties of the photosensitive drum 14. Thus, the light amount of the illuminating lamp 3 is set to a proper predetermined value in the printer mode. However, by increasing the light amount of the illuminating lamp 3 without sticking to the proper predetermined value, it is possible to perform efficiently the supplementary heating of the fixing device 24.

Figure 8:
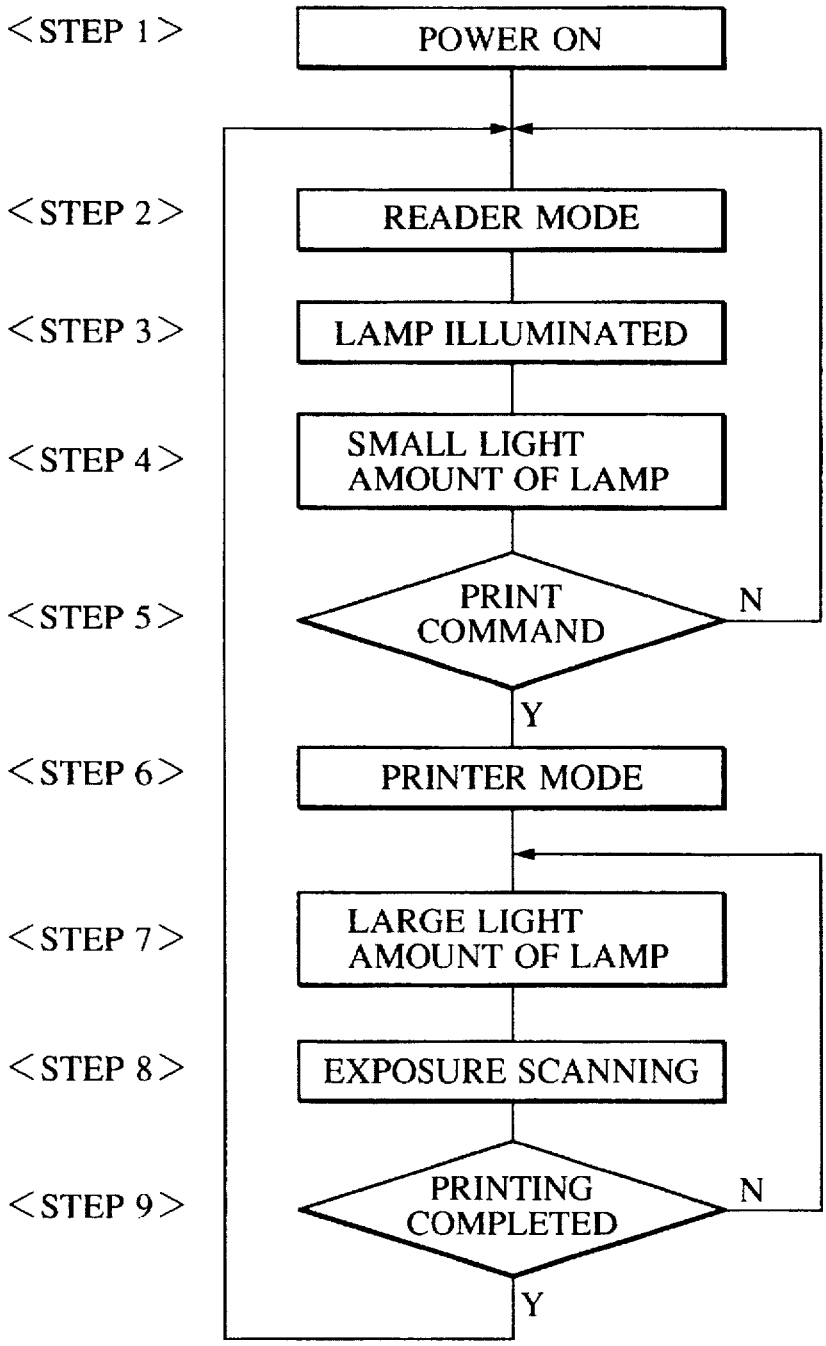
FIG. 8 is a flowchart showing an operation of a reader printer as an image forming apparatus according to a fifth embodiment of the present invention.

FIG. 8 is a flowchart showing the operation of the reader printer as the image forming apparatus according to a fifth embodiment of the present invention. The flowchart of the operation will now be described. Since this embodiment is characterized by only the flowchart of the operation with respect to the above first to third embodiments, the construction, function and block diagram of the control of the reader printer according to this embodiment are the same as those of the above first to third embodiments, and an explanation thereof has been omitted.

When an operator turns the power ON by means of the power switch 51 (step 1), the apparatus is placed in the reader mode (step 2), the illuminating lamp 3 is illuminated by the lamp driving circuit 54 (step 3), and a light amount of the illuminating lamp in the reader mode is adjusted by, for example, the operator to the proper value (step 4).

Thereafter, when a print command is generated by the print switch 52 (step 5), the reader mode is switched to the printer mode (step 6), the light amount of the illuminating lamp 3 is set to a predetermined value larger than that of the reader mode (step 7) and image exposure is performed until printing is completed (steps 7 to 9). However, unless the print command is generated in step 5, steps 2 to 4 are repeated so that a supplementary heating of the fixing device due to illumination of the illuminating lamp 3 is performed.

As described above, this embodiment is characterized in that the light amount of the illuminating lamp 3 in the printer mode is increased to be larger than that of the reader mode.

It is necessary to control the light amount of the illuminating lamp 3 which projects an image onto the projecting screen 9 for the purpose of preventing deterioration of the film image, and in accordance with the preference and eyesight of the operator, and ambient brightness, but there may be a case where the illuminating lamp is used with a small light amount. However, by setting the light amount of the illuminating lamp 3 in the printer mode to a predetermined value larger than that of the reader mode without sticking to the light amount value in the reader mode, it is possible to increase an exposure value and perform efficiently the supplementary heating of the fixing device 24.

Figure 9:
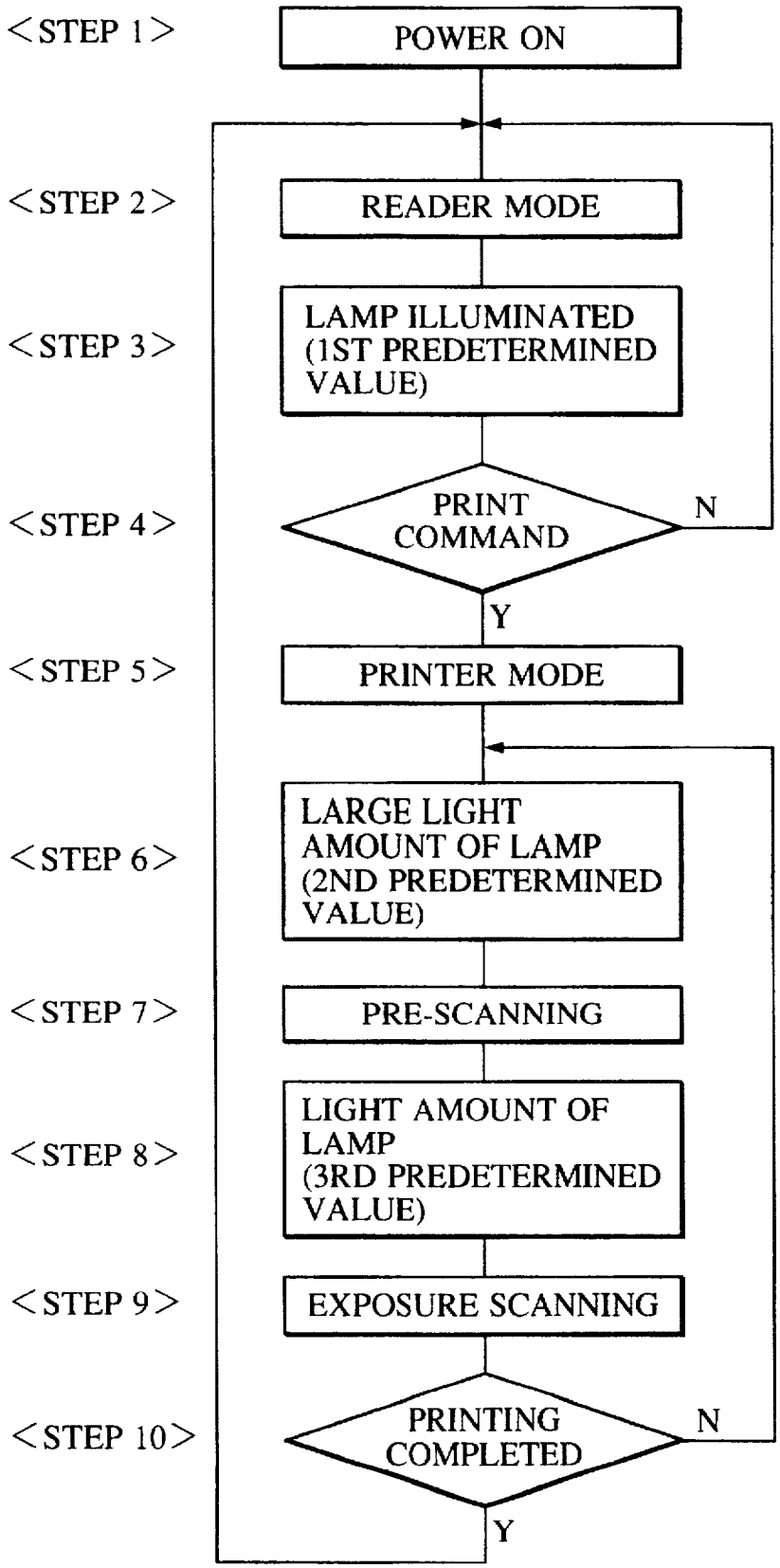
FIG. 9 is a flowchart showing an operation of a reader printer as an image forming apparatus according to a sixth embodiment of the present invention.

FIG. 9 is a flowchart showing the operation of the reader printer as the image forming apparatus according to a sixth embodiment of the present invention. The flowchart of the operation will now be described. Since this embodiment is characterized by only the flowchart of the operation with respect to the above first to third embodiments, the construction, function and block diagram of the control of the reader printer according to this embodiment are the same as those of the above first to third embodiments, and an explanation thereof has been omitted.

When an operator turns the power ON by means of the power switch 51 (step 1), the apparatus is placed in the reader mode (step 2), the illuminating lamp 3 is illuminated by the lamp driving circuit 54 (step 3), and the light amount of the illuminating lamp 3 is set to a first predetermined value.

Then, when a print command is generated by the print switch 52 (step 4), the reader mode is switched to the printer mode (step 5), and the light amount of the illuminating lamp 3 in switching to the printer mode is set to a second predetermined value larger than that of the reader mode (step 6). This switching takes place in a pre-scanning step (step 7). During the pre-scanning, the mirror 7 is rotated to a print exposure starting position.

When the pre-scanning is completed and the mirror 7 reaches the print exposure starting position, the light amount of the illuminating lamp 3 is set to a third predetermined value (smaller than the second predetermined value) in accordance with the sensitivity and the properties of the photoconductive drum 14 (step 8). After setting to the third predetermined value, image exposure to the photoconductive drum 14 is started, and image exposure is performed until printing is completed (steps 6 to 10). However, unless the print command is generated in step 4, steps 2 and 3 are repeated so that a supplementary heating of the fixing device 24 due to illumination of the illuminating lamp 3 is performed.

As shown in steps 6 and 7, this embodiment is characterized in that the light amount of the illuminating lamp 3 is increased and adjusted in three steps when the reader mode is switched to the printer mode, i.e. at the time of the pre-scanning in which rotation of the mirror 7 is started at the mirror driving section 56 and placed in each mode.

Even when the proper value and the upper limit value of the light amount of the illuminating lamp 3 required in the printer mode and the reader mode are determined, by increasing the light amount of the illuminating lamp 3 in switching between the printer mode and the reader mode, it is possible to perform efficiently the supplementary heating of the fixing device 24.

In each of the above embodiments, the image forming apparatus has been described in which the fixing device 24 is heated by utilizing heat of the illuminating lamp 3 in the reader mode. However, since it is essential only that the supplementary heating can be performed, the mode of the apparatus is not limited only to the reader mode, and the fixing device may be supplementarily heated by the illuminating lamp at all times.

As described above, according to the present invention, the heater-type fixing device can be supplementarily warmed by the light and heat from the illuminating lamp for projecting the image at all times, or only in the reader mode of the image forming apparatus which can be switched between the reader mode and the printer mode. Therefore, the present invention offers the following advantages.

1) The rise time of the heat-type fixing device can be shortened.
2) A heat insulation condition of the heat-type fixing device is improved, whereby operating time of the heater for heating the heating roller can be shortened.
3) Good fixing property can be obtained even in a low-temperature environment.

By providing the heater-type fixing device and the illuminating section adjacent to each other, the ambient temperature of the heater-type fixing device is increased by using the heat emitted from the illuminating section so that the heater-type fixing device is warmed.

In addition, by applying the light emitted from the illuminating lamp 3 directly to the heater-type fixing device or the heating roller, not only convection heat but also radiation heat of the illuminating lamp is supplied to the heat-type fixing device or the heating roller so that the fixing device or the heating device is further warmed.

Further, by coloring the outer wall of the illuminating section of the fixing device frame with a color of high heat efficiently, the rate of heat-absorbing is increased so that the heat-type fixing device or the heating roller is further warmed.

Still further, by forming the exhaust duct at the heat-type fixing device frame, the fixing device or the heating roller is warmed by hot air, which is to be discharged out of a main body of the apparatus, passing through the exhaust duct.

Therefore, the more the heat-type fixing device is warmed, the more the above-described advantages are achieved.

In addition, a direct application of the light of the illuminating lamp to the heating roller can compensate for the heat of the heating roller removed by a cooled transfer material, particularly in a low-temperature environment. Thus, no defect in fixing due to deficient influence of heating on the printing operation is generated.

Further, when the heater-type fixing device is warmed by hot air passing through the exhaust duct, the heater-type fixing device will not be overheated because the hot air is discharged. Thus, a breakdown of the heater-type fixing device due to heat can be prevented.

Still further, the supplementary heating is economical because it uses the light and heat emitted from the illuminating lamp as described above. The supplementary heating thus also reduces energy consumption. When the supplementary heating is performed only in the reader mode, it becomes more economical and further reduces the energy consumption.

The proper value and the upper limit value of the light amount of the illuminating lamp required for printing in the printer mode may be sometimes determined by the sensitivity and the properties of the photoconductive drum as an exposure section. However, by increasing the light amount of the illuminating lamp in the reader mode to be larger than that of the printer mode, it is possible to perform efficiently the supplementary heating of the heater-type fixing device.

In addition, the proper value and the upper limit value of the light amount of the illuminating lamp for projecting an image may be sometimes determined for the purpose of preventing deterioration of the image, and in accordance with the preference and eyesight of the operator. However, by increasing the light amount of the illuminating lamp in the printer mode to be larger than that of the reader mode, it is possible to perform efficiently the supplementary heating of the heater-type fixing device.

Further, even when the proper value and the upper limit value of the light amount of the illuminating lamp required in the printer mode and the reader mode are determined, by selecting the light amount of the illuminating lamp to the value corresponding to that of the printer mode, the reader mode and the switching between these modes, and by increasing the light amount of the illuminating lamp in switching between the printer mode and the reader mode, it is possible to perform efficiently the supplementary heating of the heater-type fixing device.

What is claimed is:

1. An image forming apparatus, comprising:

reading means for projecting an image on a recording medium onto a screen for observation in a reading mode;

printing means for printing the image on a recording sheet in a printing mode;

a lamp illuminating the recording medium;

a fixing section for fixing the image on the recording sheet by heat; and heating means for supplementarily heating said fixing section with the heat generated from said lamp in the reading mode, wherein said heating means includes a duct for discharging the heat from said lamp out of a main body of the apparatus after guiding the heat to said fixing section.

2. An image forming apparatus according to claim 1, wherein said fixing section includes a heater and a fixing roller heated by said heater.

3. An image forming apparatus according to claim 2, wherein said fixing roller is heated by the heat from said lamp.

4. An image forming apparatus according to claim 2, wherein said fixing roller is irradiated with light of said lamp.

5. An image forming apparatus according to claim 1, wherein said lamp is disposed in the vicinity of said fixing section.

6. An image forming apparatus according to claim 1, wherein said heating means applies light from said lamp to said fixing section through a through hole formed in a frame enclosing said lamp.

7. An image forming apparatus according to claim 6, wherein an outer wall of said fixing section proximate to said lamp is of a color having high heat absorptivity.

8. An image forming apparatus according to claim 1, wherein an image is formed on said recording sheet by a developing toner.

9. An image forming apparatus according to claim 1, wherein the light amount of said lamp in the reading mode is larger than the light amount in the printing mode.

10. An image forming apparatus according to claim 1, wherein the light amount of said lamp in the printing mode is larger than the light amount in the reading mode.

11. An image forming apparatus, comprising:

reading means for projecting an image on a recording medium onto a screen for observation in a reading mode;

printing means for printing the image on a recording sheet in a printing mode;

a lamp illuminating the recording medium;

a fixing section for fixing the image on the recording sheet by heat; and heating means for supplementarily heating said fixing section with the heat generated from said lamp in the reading mode, wherein the light amount of said lamp can be selected to be a first value in the printing mode, a second value in the reading mode and a third value during the switching between the printing mode and the reading mode.

12. An image forming apparatus, comprising:

reading means for projecting an image on a recording medium onto a screen for observation in a reading mode;

printing means for printing the image on a recording sheet in a printing mode;

an image illuminating section having a lamp for illuminating the recording medium; and a heater-type fixing device for fixing the copied image on a recording sheet; and an exhaust for discharging at least an amount of air heated by said lamp, wherein said fixing device receives heat from the heated air.

13. An image forming apparatus, comprising:

reading means for projecting an image on a recording medium onto a screen for observation in a reading mode;

printing means for printing the image on a recording sheet in a printing mode;

an image illuminating section having a lamp for illuminating the recording medium;

a heater-type fixing device for fixing the copied image on a recording sheet; and a ventilation device for discharging at least an amount of air heated by said lamp out of said device after leading said heated air to said fixing device.

14. An image forming apparatus, comprising:

reading means for projecting an image on a recording medium onto a screen for observation in a reading mode;

printing means for printing the image on a recording sheet in a printing mode;

an image illuminating section having an illuminating lamp;

a heater-type fixing device for fixing the copied image; and a frame supporting said heater-type fixing device, with an outer wall of said frame proximate to said illuminating lamp having a color high in heat absorptivity, wherein the light of said illuminating lamp is applied to the colored frame of said heater-type fixing device, so that said heater-type fixing device is heated in the reading mode.

15. An image forming apparatus, comprising:

reading means for projecting an image on a recording medium onto a screen for observation in a reading mode;

printing means for printing the image on a recording sheet in a printing mode;

an image illuminating section having an illuminating lamp;

a heater-type fixing device for fixing the copied image;

a frame supporting said heater-type fixing device; and an exhaust duct for discharging the heat generated by said illuminating lamp out of a main body of said apparatus, wherein said exhaust duct is formed by part of said frame, and said heater-type fixing device is heated by using the exhausted heat of said illuminating lamp generated in said reading mode.

16. An image forming apparatus, comprising:

reading means for projecting an image on a recording medium onto a screen for observation in a reading mode;

printing means for printing the image on a recording sheet in a printing mode;

a lamp illuminating the recording medium;

a fixing section for fixing the image on the recording sheet by heat; and heating means for supplementarily heating said fixing section with the heat generated from said lamp in the reading mode, wherein said heating means applies light from said lamp to said fixing section through a through hole formed in a frame enclosing said lamp, and an outer wall of said fixing section proximate to said lamp is of a color having high heat absorptivity.

* * * * *

UNITED STATES PATENT AND TRADEMARK OFFICE

CERTIFICATE OF CORRECTION

PATENT NO. : 5,752,129

DATED : May 12, 1998

INVENTOR(S) : Sugiyama

It is certified that error appears in the above-identified patent and that said Letters Patent is hereby corrected as shown below:

COLUMN 4:

Line 51, "der se" should read --per se,--.

Signed and Sealed this

Twelfth Day of January, 1999

*Attest:*

*Attesting Officer*

*Acting Commissioner of Patents and Trademarks*